US007914168B2

(12) United States Patent
Oliva

(10) Patent No.: US 7,914,168 B2
(45) Date of Patent: Mar. 29, 2011

(54) POP-UP CHRISTMAS TREE

(75) Inventor: Barbara L. Oliva, Palatine, IL (US)

(73) Assignee: BoPal LLC, Palatine, IL (US)

( * ) Notice: Subject to any disclaimer, the term of this patent is extended or adjusted under 35 U.S.C. 154(b) by 226 days.

(21) Appl. No.: 12/154,150

(22) Filed: May 21, 2008

(65) Prior Publication Data

US 2009/0289560 A1 Nov. 26, 2009

(51) Int. Cl.
*F21S 6/00* (2006.01)

(52) U.S. Cl. ..... 362/123; 362/249.19; 362/431; 362/806; 248/157; 428/9; 428/18

(58) Field of Classification Search ..... 362/123, 362/249.18, 249.19, 431, 567, 806; 211/196, 211/205; 248/528; 428/9, 18, 20
See application file for complete search history.

(56) References Cited

U.S. PATENT DOCUMENTS

| | | | | |
|---|---|---|---|---|
| 2,731,752 | A * | 1/1956 | Erickson et al. | 362/123 |
| 4,130,678 | A * | 12/1978 | Higgins | 428/9 |
| 5,413,825 | A * | 5/1995 | Chaikin | 428/18 |
| 5,455,750 | A * | 10/1995 | Davis et al. | 362/123 |
| 7,195,216 | B2 * | 3/2007 | Wang | 248/157 |
| 2005/0048226 | A1 * | 3/2005 | Gary et al. | 428/18 |

* cited by examiner

*Primary Examiner* — Stephen F Husar

(57) ABSTRACT

A pop-up Christmas tree that is formed by translucent spandex printed fabric member, printed with a graphic of a real Christmas tree, wrapped into a cone shape. An electrically motorized power antenna assembly is located within the hollow trunk of the tree display. A plurality of supporting frames and cords are mounted inside the fabric cone shape. The antenna tip is attached to the internal apex of the fabric cone shape. The base of the cone shape is attached to the perimeter of a molded plastic tree base housing. When the user activates the power antenna via a remote control switch, the tree shape rises from its base housing to instantly form a realistic Christmas tree shape. The walls of the fabric cone shape include apertures that hold standard Christmas lights and hooks for ornaments.

2 Claims, 6 Drawing Sheets

POP-UP CHRISTMAS TREE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of artificial Christmas tree construction and more specifically to a pop-up Christmas tree.

Christmas trees are a common feature of the Christmas holiday season. They are traditionally cut pine trees or fur trees that are supported by a metal or wooden base and are decorated with lights, ornaments and other eye catching accessories.

In an effort to create a reusable Christmas tree, a number of inventors have proposed artificial trees that are comprised of a trunk member and branches that can fold out when in use, but otherwise be folded up for storage. Other inventors have proposed more abstract versions of Christmas trees that can also be taken apart or collapse for storage and shipping purposes.

U.S. Pat. No. 4,172,913 shows a telescoping tree trunk. Each flange on top of each telescoping tube holds branches.

U.S. Pat. No. 4,343,842 shows a pole-branch assembly where the branches are mounted on tubes that slip over a central tube. Branches get dropped into sockets on each branch assembly.

U.S. Pat. No. 5,359,502 shows a tree where transparent tubes form a tee pee like structure with lights built into a strand that wraps around the tree.

U.S. Pat. No. 6,062,701 shows another version of a telescoping center pole where concentric disks hold lights and the disks are held in place by ropes that get pulled taught and staked into the ground. It is for outdoor use.

U.S. Pat. No. 6,320,327 discusses a "remote" feature where the base can be made to rotate by pushing a button on a remote. Other buttons can be pressed to turn lights on or music on.

U.S. Pat. No. 7,195,216 shows an adjustable trunk for a tree that is telescoping and uses a reel and cable to raise the trunk. Turning the reel either mechanically or automatically by motor causes the trunk to rise or lower.

Patent application (not issued yet) 2005/0048226A1 shows a tree with a telescoping center pole and a plurality of rings that are supported by the pole. Each ring has branches plugged into it.

However there is a deficiency in the prior technology in that none of the designs in the prior art provide a tree display that uses a realistic printed image of a Christmas tree printed on an elastic translucent fabric so that the tree can be raised from a relatively flat pancake shape to a fully extended cone shape in a matter of seconds via an internal telescoping power antenna type assembly and where all the decorations for the tree including lights and ornaments are in place when the tree is in its raised position, and where the tree can be returned to its flat storage position in a matter of seconds.

BRIEF SUMMARY OF THE INVENTION

The primary object of the invention is to provide a Christmas tree that can automatically pop up from a flat pancake shape to a fully deployed and decorated tree at the push of a button from a hand held remote control device.

Another object of the invention is to provide a pop-up Christmas tree that incorporates a storage container within its design.

Another object of the invention is to provide a pop-up Christmas tree that uses a printed graphic of a Christmas tree applied to translucent spandex material to create the illusion of a real pine tree.

A further object of the invention is To provide a pop-up Christmas tree that can be light from within.

Yet another object of the invention is To provide a pop-up Christmas tree that incorporates Christmas lights and ornaments that are attached to the spandex fabric and lower and raise with the spandex tree graphic.

Still yet another object of the invention is to provide a pop-up Christmas tree that includes, built with in itself, an electronic audio device that plays Christmas songs.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a pop-up Christmas tree comprising: a translucent spandex printed fabric member wrapped to form a cone shape, an electrically motorized power antenna assembly, a storage base housing, a housing lid, a cylindrical member representing a tree trunk, a base plate, a plurality of fabric frames, a plurality of fabric supporting cords a plurality of Christmas lights, a plurality of ornament holding hooks, a standard hand held remote control transmitter and associated standard receiving electronics, an inner tree illuminating fixture and a 110 VAC power cord and plug. Said power antenna assembly residing in said cylindrical trunk member, said antenna tip attached to the inner apex of said fabric cone shape, said fabric member printed with the image of a standard Christmas tree so that when said fabric member is wrapped into a cone shape it resembles a standard Christmas tree, said cone shaped fabric member attached at its base to one said fabric frame located at the top lip of said base housing, said additional fabric frames held one above the other by said supporting cords so that said frames and said cords provide a supporting structure for the side walls of said fabric cone member, said fabric cone shape side walls having a plurality of apertures that allow said plurality of Christmas lights to penetrate outward so that said lights can be seen on the outside surface of said fabric, said ornament holding hooks fixedly attached to the side walls of said fabric cone enabling a user to decorate said cone shape with standard Christmas ornaments, said inner tree illuminating fixture able to cause said Christmas tree graphic to be internally illuminated so that said printed translucent fabric glows, said plurality of ornament holding hooks fixed to the outside of said fabric side walls, said power antenna assembly operated by said standard hand held remote control and said standard receiving electronics, said Christmas lights and said inner tree illuminating fixture also activated by said remote control and standard receiving electronics and said lights and said power antenna powered via said power cord and said power plug by 110 VAC power from a standard wall socket, so that a user can operate said remote control device to cause said power antenna to rise thereby causing said attached cone shaped fabric to rise and form a Christmas tree like shape that can also be illuminated by said user by use of said remote control device. Said user can operate said remote control device to cause said power antenna to lower thereby causing said attached cone shaped fabric to return to its storage position where said user can enclose said fabric with said housing lid.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
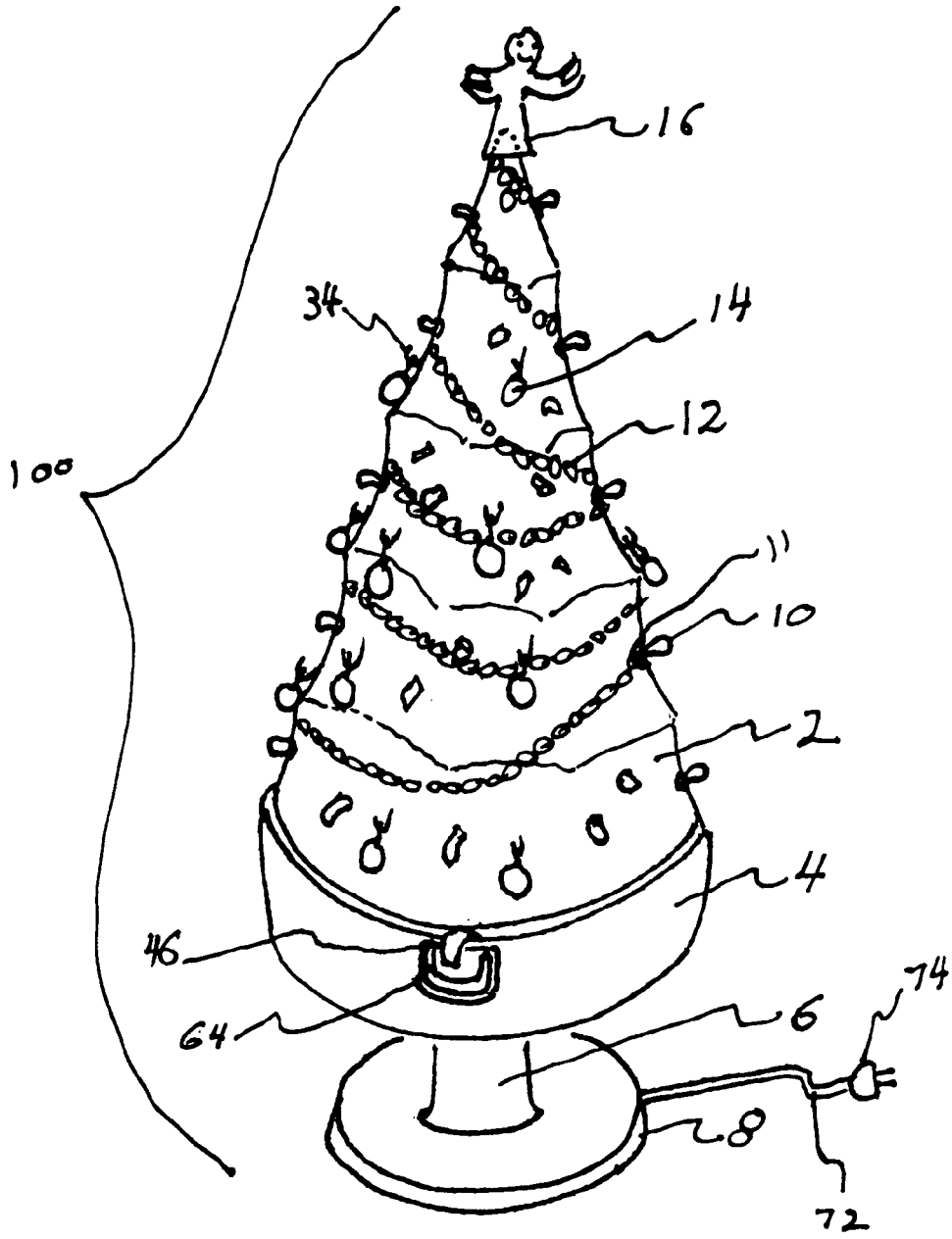
FIG. 1 is a perspective view of the invention in the deployed position.
Figure 2:
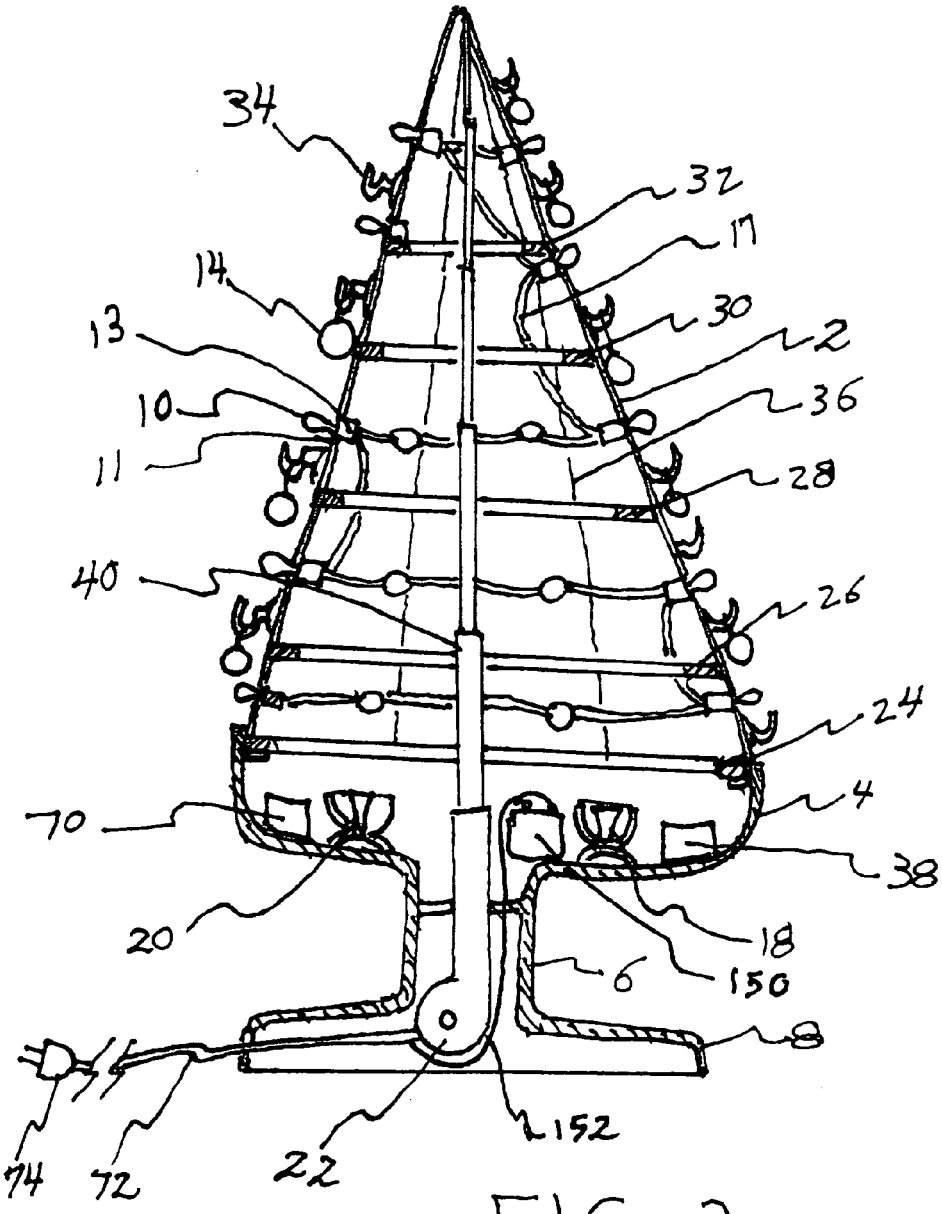
FIG. 2 is a side section view of the invention in the deployed position.

Referring no to FIG. 1 we see a perspective view of the invention 100 in its fully deployed state. A cone of spandex type fabric is attached at its bottom edge to an internal frame located at the top surface of a hollow housing 4. The fabric 2 has a printed graphic of a Christmas tree, which is taken from an actual pine tree and looks very realistic. The application of a photo realistic image to translucent spandex can be done by a specialty company such as Fabric Images Corp. of Elgin, Ill. A real pine tree was photographed from each side and spliced together to make a continuous image that when wrapped into a cone shape, resembles a real pine tree. Apertures 11 in the fabric 2 allow Christmas tree lights 10 to penetrate and be seen on the outside of the fabric 2. The unsightly wires 17 and sockets 13 that connect the lights remain hidden on the inside of the tree graphic 2. The lights 10 and other internal components that require electricity are powered by standard 110 VAC via power cord 72 and plug 74. Alternately, the entire invention 100 may be powered by battery power 150 and connecting wires 152 as shown in FIG. 2 so that the invention can be used in places where no power outlets are available. J hooks 34 are affixed to the outside of tree graphic 2 allowing the user to decorate the tree 2 with his or her favorite ornaments 14. Alternately, the tree can come pre-assembled with ornaments already attached. For decorative purposes an angel 16 has been placed at the very top of the tree 2. Christmas beads 12 are also pre-hung on the tree graphic 2. Base plate 8, cylindrical trunk 6 and hollow base housing 4 are made from rigid materials such as molded plastic and provide a sturdy support for the tree structure. The overall effect of the present invention is a surprisingly realistic version of a Christmas tree, however this tree 100 does not require actual physical branches and can be set up or taken down in five seconds.

Figure 6:
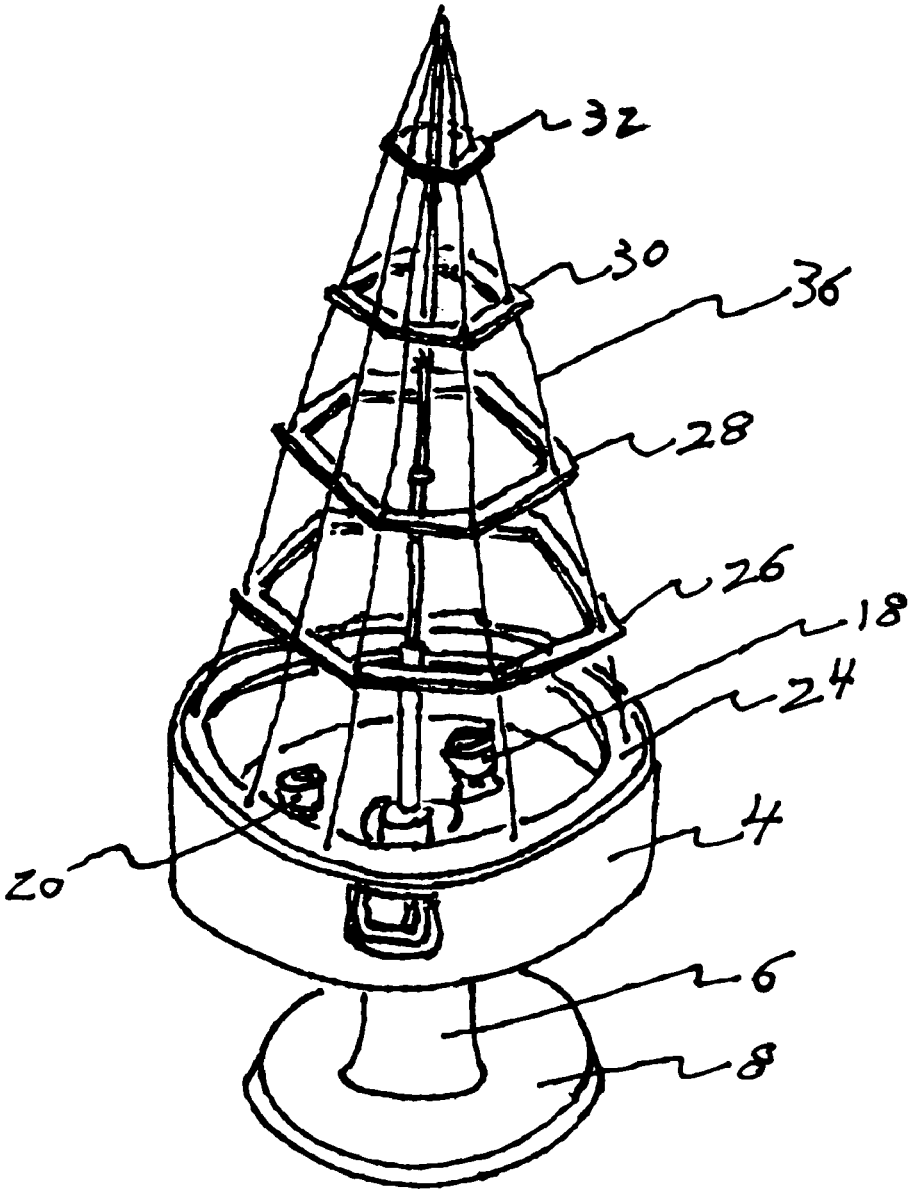
FIG. 6 is a perspective view of the invention with the fabric cover removed.

FIG. 2 shows a side section view of the invention. A standard power antenna 22 can be seen centrally located within cylindrical trunk portion 6. The antenna has telescoping members 40 that can be raised or lowered by remote control activation as will be described below. The entire raising or lowering of the telescoping members takes less than five seconds and thereby allows the invention 100 to be set up or taken down very quickly. The fabric cone shape 2 keeps its shape by means of a series of rigid frames 24, 26, 28, 30, 32. The frames are held in place by structural cords 36. FIG. 6 shows a view of the invention with the fabric covering 2 removed. This view clearly shows the support frames and support cords described above. The wires 17 and light bulb sockets 13 that provide power to the Christmas lights 10 remain hidden within the cone shape 2. A pair of lighting fixtures 18, 20 aim light up within cone 2 and cause the entire cone shape to glow from within. This effect gives greater clarity and definition to the photographic representation of the pine tree branches and pine cones depicted on the tree graphic printed onto fabric cone shape 2. Optional standard audio generating 70 fits within base housing 4 and can also be activated by hand held remote 50 thereby playing holiday songs when so desired. Housing 38 indicates the standard receiving station that receives signals from remote control unit 50 and tells each of the electrically operated devices within the base housing 4 to turn on or off. Remote control unit 50 is described in detail below.

Figure 3:
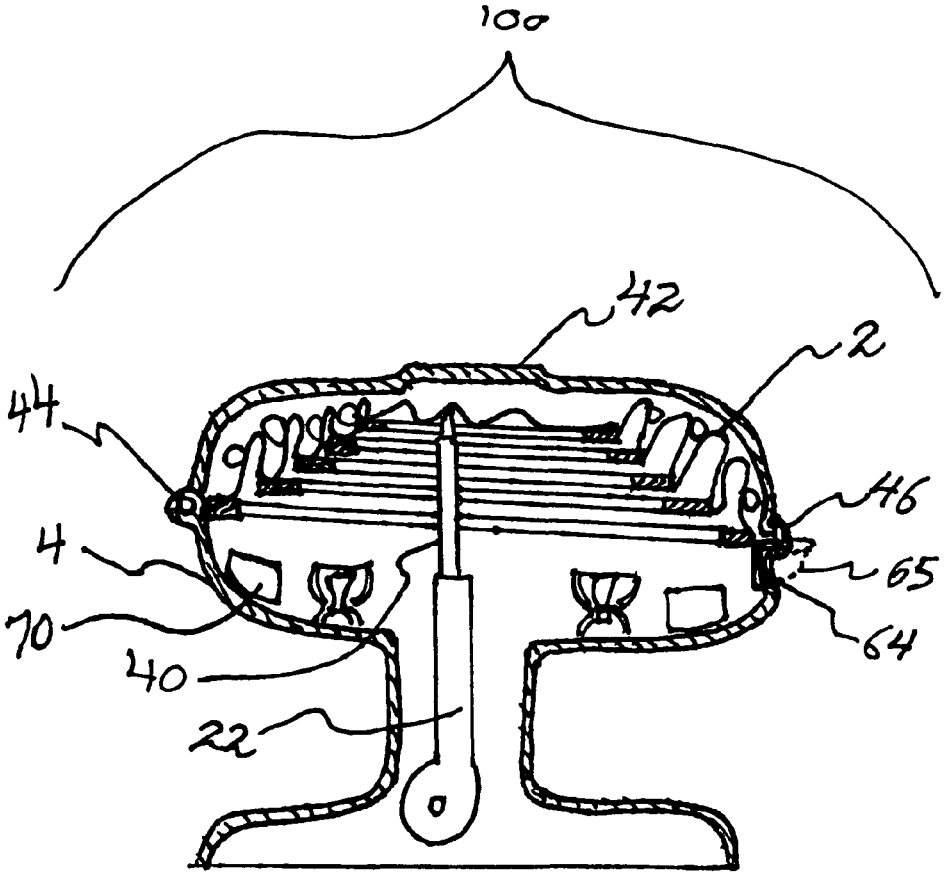
FIG. 3 is a side section view of the invention in the collapsed storage position.

FIG. 3 shows a present invention 100 in its collapsed and stored condition. Telescoping pole members 40 have been retracted into housing 22. The fabric cone shape 2 as well as supporting frames 26, 28, 30, 32 have collapsed onto themselves and fallen into a flat pancake shape. Hinged 44 Lid 42 is placed over the collapsed structure for storage purposes. The hinge portion 44 is designed to snap into place in a standard way so that the hinge can be detached and the lid 42 removed from the rest of the tree assembly during operation of the tree 100. Standard latch 46 holds the lid in place during storage and shipping. Hand carry handle 64 can be swung out as shown by dotted line 65 when needed to carry the invention 100 conveniently.

Figure 4:
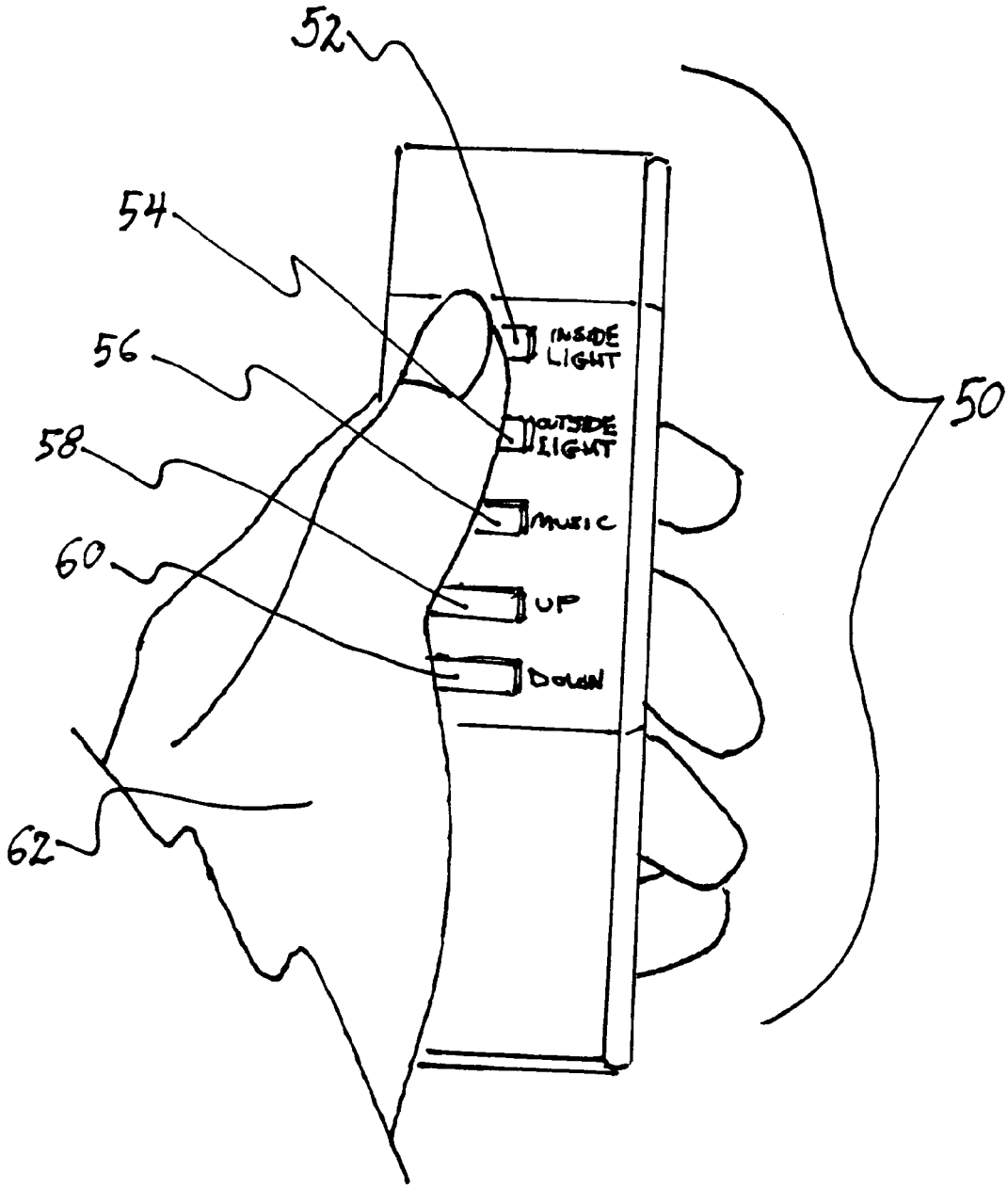
FIG. 4 is a perspective view of a person holding the remote control device.

FIG. 4 shows a person's hand 62 holding the remote control unit 50 of the present invention. Five buttons are shown. Each button can turn a particular feature on or off. The remote control unit is well known and is made by UPM Corporation and distributed by Smart Home Corporation. Button 52 turns the inside lights 18, 20 on or off. Button 54 turns the outside lights 10 on or off. Button 56 turns the music generated by audio device 38 on or off. Button 58 causes the telescoping members 40 to rise. Button 60 causes telescoping members 40 to lower.

Figure 5:
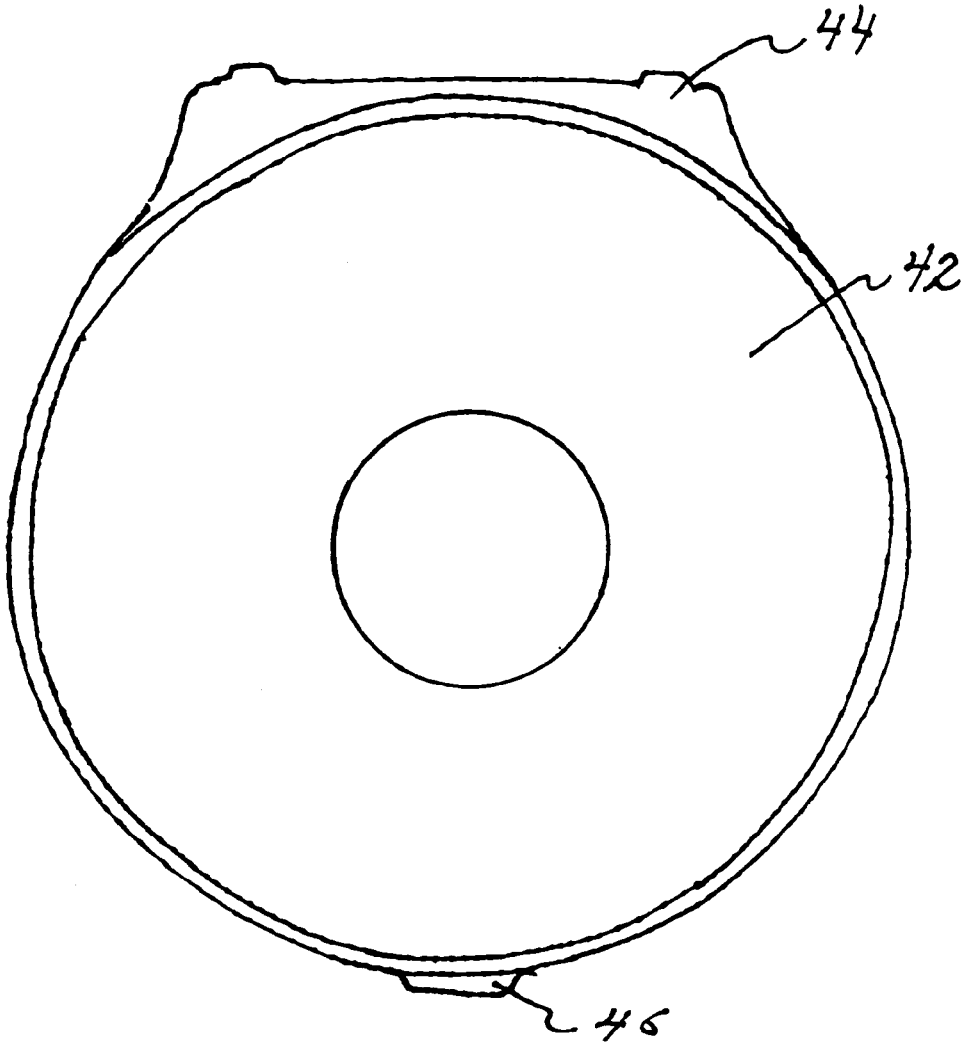
FIG. 5 is a top view of the invention in the closed storage position.

FIG. 5 shows a top view of the invention in the collapsed position with the lid 42 in place. Hinge portion 44 and latching portion 46 can be seen.

FIG. 6 shows a view of the invention with the fabric cover 2 removed and has been described above.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A pop-up Christmas tree comprising:
a cone shaped fabric member;
a standard motorized telescoping antenna assembly;
a hollow base portion;
a lid portion;
a plurality of horizontally disposed fabric supporting frames;
a plurality of vertically disposed frame supporting cords;
a plurality of standard exterior lighting devices;
a plurality of J shaped hooks;
a standard remote control transmitter and receiver assemblies;
one or more standard interior lighting devices;
a standard power cord and plug assembly;
said base portion including a flat horizontally disposed floor engaging lower plate affixed to a hollow cylindrical member and a centrally located bowl shaped housing;
said antenna assembly residing within said cylindrical member;
said antenna assembly having an antenna tip which is attached to the inner apex of said cone shape;
said supporting cords attached at one end to the top of said antenna assembly and attached radially at the opposite end to the lip of said bowl shaped housing;
said horizontal frame members spaced one above the other within said cone shaped fabric member and held in place by said supporting cords;
the exterior of said cone shaped fabric member printed with a realistic image of a pine tree;
the base of said cone shaped fabric member removably attached by standard fastening means to the lip of said bowl shaped housing;
the side walls of said cone shaped fabric member having a plurality of apertures;
said apertures allowing a plurality of said exterior lighting devices to protrude through said cone shaped fabric member;
said J hooks fixedly attached to the exterior side walls of said cone shaped fabric member;
said interior lighting devices affixed to the inside lower surface of said bowl shaped housing;
said receiver assembly affixed to the inside lower surface of said bowl shaped housing;
said transmitter capable of sending signals to said receiver to raise or lower said antenna assembly and to turn on or off said interior and exterior lights;
said lights and said antenna assembly connected by said power cord and plug to a standard 110 VAC source.

2. A pop-up Christmas tree comprising:
a cone shaped fabric member;
a standard motorized telescoping antenna assembly;
a hollow base portion;
a lid portion;
a plurality of horizontally disposed fabric supporting frames;
a plurality of vertically disposed frame supporting cords;
a plurality of standard exterior lighting devices;
a plurality of J shaped hooks;
a standard remote control transmitter and receiver assemblies;
one or more standard interior lighting devices;
said base portion including a flat horizontally disposed floor engaging lower plate affixed to a hollow cylindrical member and a centrally located bowl shaped housing;
said antenna assembly residing within said cylindrical member;
said antenna assembly having an antenna tip which is attached to the inner apex of said cone shape;
said supporting cords attached at one end to the top of said antenna assembly and attached radially at the opposite end to the lip of said bowl shaped housing;
said horizontal frame members spaced one above the other within said cone shaped fabric member and held in place by said supporting cords;
the exterior of said cone shaped fabric member printed with a realistic image of a pine tree;
the base of said cone shaped fabric member removably attached by standard fastening means to the lip of said bowl shaped housing;
the side walls of said cone shaped fabric member having a plurality of apertures;
said apertures allowing a plurality of said exterior lighting devices to protrude through said cone shaped fabric member;
said J hooks fixedly attached to the exterior side walls of said cone shaped fabric member;
said interior lighting devices affixed to the inside lower surface of said bowl shaped housing;
said receiver assembly affixed to the inside lower surface of said bowl shaped housing;
said transmitter capable of sending signals to said receiver to raise or lower said antenna assembly and to turn on or off said interior and exterior lights;
said lights and said antenna assembly are powered by a portable battery source located within said bowl shaped housing.

* * * * *